US012385426B2

(12) United States Patent
Yano

(10) Patent No.: US 12,385,426 B2
(45) Date of Patent: Aug. 12, 2025

(54) EXHAUST MANIFOLD

(71) Applicant: TOYOTA JIDOSHA KABUSHIKI KAISHA, Toyota (JP)

(72) Inventor: Masaaki Yano, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 107 days.

(21) Appl. No.: 18/479,141

(22) Filed: Oct. 2, 2023

(65) Prior Publication Data

US 2024/0175388 A1 May 30, 2024

(30) Foreign Application Priority Data

Nov. 30, 2022 (JP) ..... 2022-191687

(51) Int. Cl.
*F01N 13/10* (2010.01)
*F01N 13/18* (2010.01)

(52) U.S. Cl.
CPC ..... *F01N 13/10* (2013.01); *F01N 13/1805* (2013.01)

(58) Field of Classification Search
CPC ... F01N 13/10; F01N 13/1805; F01N 13/1872
See application file for complete search history.

(56) References Cited

U.S. PATENT DOCUMENTS

2010/0293931 A1* 11/2010 Peters ..... B01F 25/4315 366/337

FOREIGN PATENT DOCUMENTS

| | | | |
|---|---|---|---|
| JP | 2008-115797 A | | 5/2008 |
| JP | 2017-214840 A | | 12/2017 |
| JP | 2018-96347 A | | 6/2018 |
| JP | 2018096347 A | * | 6/2018 |
| JP | 3239740 U | | 11/2022 |

OTHER PUBLICATIONS

JP-2018096347-A (Year: 2018).*

* cited by examiner

*Primary Examiner* — Anthony Ayala Delgado
(74) *Attorney, Agent, or Firm* — Oblon, McClelland, Maier & Neustadt, L.L.P.

(57) ABSTRACT

An exhaust manifold includes first and second plate members fixed to an inlet of a junction pipe at which exhaust gases from exhaust pipes join together. The first and second plate members are combined with each other so as to partition the inlet for each of the exhaust pipes. The first plate member includes a slit into which the second plate member is inserted. A width of the slit is greater than a plate thickness of the second plate member. The first plate member is provided with first and second contact portions. The first and second contact portions respectively protrude from opposite sides of the slit in a width direction of the slit and contact with the second plate member inserted into the slit.

3 Claims, 6 Drawing Sheets

EXHAUST MANIFOLD

CROSS-REFERENCE TO RELATED APPLICATION

This application is based upon and claims the benefit of priority of the prior Japanese Patent Application No. 2022-191687, filed on Nov. 30, 2022, the entire contents of which are incorporated herein by reference.

TECHNICAL FIELD

The present disclosure relates to an exhaust manifold.

BACKGROUND

For example, Japanese Unexamined Patent Application Publication No. 2018-096347 discloses an exhaust manifold including a pair of plates joined to a fixing member that fixes a plurality of exhaust pipes collected on a downstream side of exhaust gas such that the plates cross each other in a cross shape via slits. Since the width of the slit is larger than the thickness of each plate so that the plates are easily coupled to each other, a predetermined clearance exists between the slit and the plate.

Therefore, the plate might be thermally deformed in a direction in which the slit width is reduced. On the other hand, a circular region having a diameter longer than the slit width is formed at an end portion opposite to an opening end of the slit so as to reduce concentration of stress due to, for example, thermal deformation.

However, depending on the size of the circular region, the margin between the slits might become large. As a result, the positioning accuracy of each plate might decrease, and the concentration of stress on the slit might not be sufficiently reduced. When the stress is concentrated on the slit, a crack or the like might occur in the plate from the slit as a starting point. In this way, the reliability of the exhaust manifold might be reduced.

SUMMARY

It is therefore an object of the present disclosure to provide an exhaust manifold with improved reliability.

The above object is achieved by an exhaust manifold including first and second plate members fixed to an inlet of a junction pipe at which exhaust gases from exhaust pipes join together, wherein the first and second plate members are combined with each other so as to partition the inlet for each of the exhaust pipes, the first plate member includes a slit into which the second plate member is inserted, a width of the slit is greater than a plate thickness of the second plate member, the first plate member is provided with first and second contact portions, and the first and second contact portions respectively protrude from opposite sides of the slit in a width direction of the slit and contact with the second plate member inserted into the slit.

The first and second contact portions may be provided at an opening end of the slit.

The first and second contact portions may be provided so as to sandwich the second plate member in a thickness direction of the second plate member.

Each of the first and second contact portions may be formed into a substantially trapezoidal shape in a front view of a plate surface of the first plate member, and the substantially trapezoidal shape includes an upper base that contacts with the second plate member.

Also, the above object is achieved by an exhaust manifold including first and second plate members fixed to an inlet of a junction pipe at which exhaust gases from exhaust pipes join together, wherein the first and second plate members are combined with each other so as to partition the inlet for each of the exhaust pipes, the first plate member includes a slit into which the second plate member is inserted, a width of the slit is greater than a plate thickness of the second plate member, and the first plate member is welded to the second plate member in at least a part of the slit.

DETAILED DESCRIPTION

Figure 1:
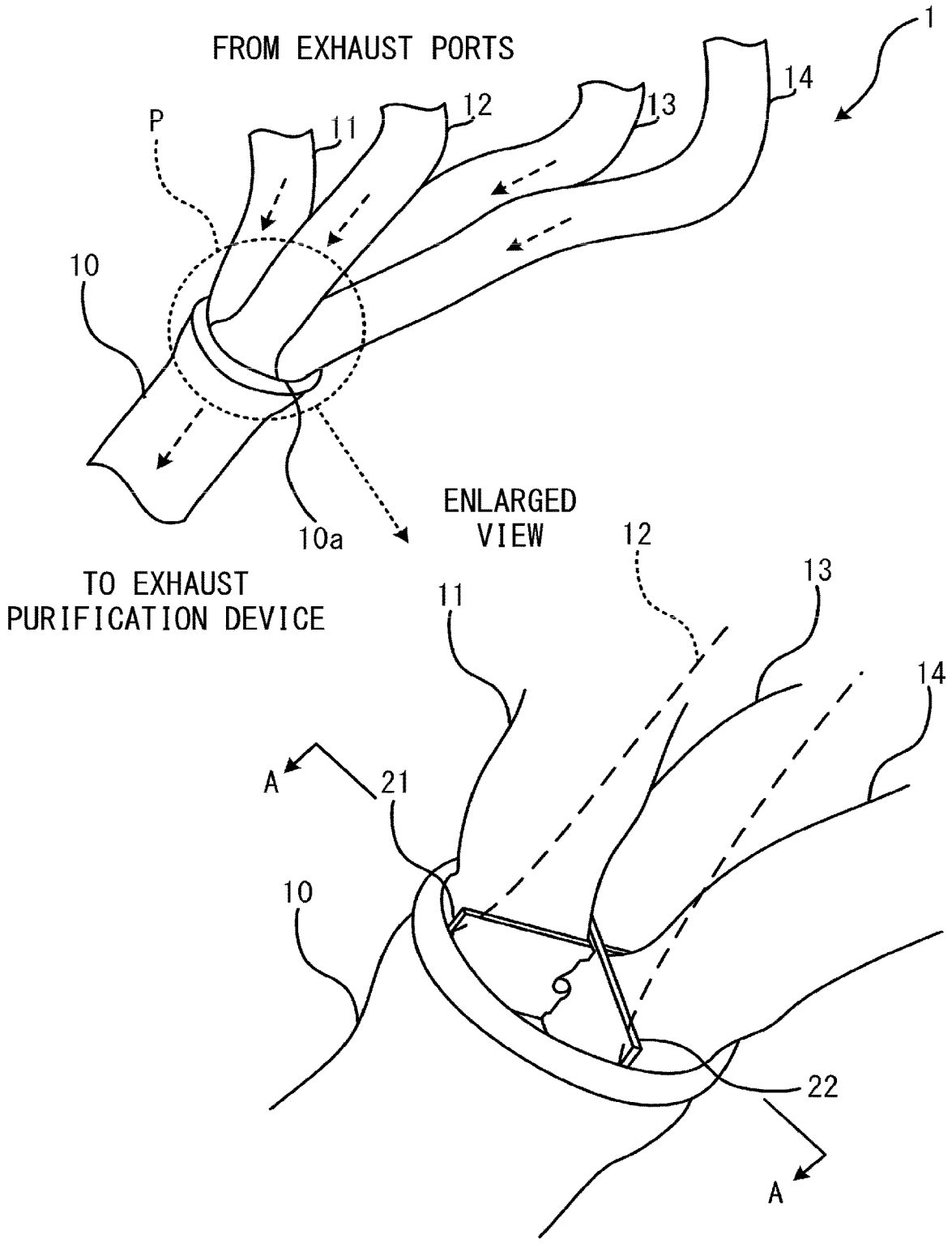
FIG. 1 is a perspective view illustrating an example of an exhaust manifold.

FIG. 1 is a perspective view illustrating an example of an exhaust manifold 1. The exhaust manifold 1 includes exhaust pipes 11 to 14 and a collector 10. The exhaust pipes 11 to 14 extend from exhaust ports (not illustrated) of an internal combustion engine such as an engine. In the collector 10, as indicated by dotted arrows, the exhaust gases flowing through the exhaust pipes 11 to 14 join together. An exhaust purification device (not illustrated) for purifying exhaust gas, for example, is connected to the downstream side of the collector 10. Although the number of cylinders of the internal combustion engine is four in the present embodiment, the number of cylinders is not limited.

The collector 10 is an example of a junction pipe. The cross-sectional area of the flow path in the collector 10 is greater than the sum of the cross-sectional areas of the exhaust pipes 11 to 14. Downstream end portions of the exhaust pipes 11 to 14 are gathered at an inlet 10*a* of the collector 10 and connected to the collector 10 by welding or the like. In the lower part of FIG. 1 there is illustrated an enlarged view of the inlet 10*a* of the collector 10, indicated by reference numeral P. In the enlarged view, the exhaust pipe 12 is illustrated by a dotted line for convenience.

A pair of plate members 21 and 22 combined such that their plate surfaces are substantially orthogonal to each other is fixed to the inlet 10*a* by welding. Each of plate surfaces of the plate members 21 and 22 is formed into a substantially rectangular shape. When the inlet 10*a* is viewed from the front, the plate members 21 and 22 are combined to form a cross shape. The plate members 21 and 22 are provided so as to partition the inlet 10*a* for each of the exhaust pipes 11 to 14.

Figure 2:
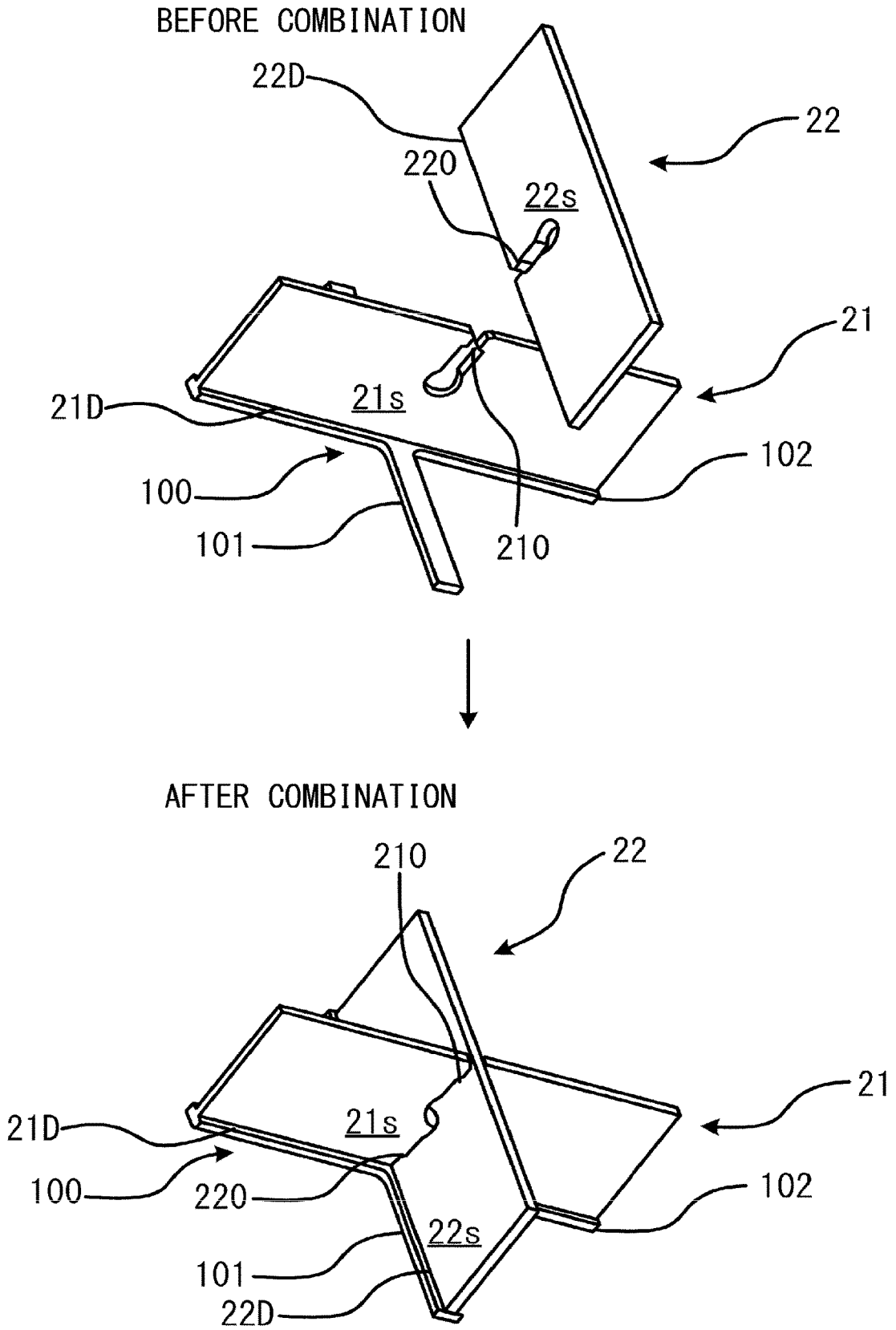
FIG. 2 is a perspective view illustrating an example of plate members before and after combination.

FIG. 2 is a perspective view illustrating an example of the plate members 21 and 22 before and after combination. The plate member 21 has a coupling slit 210. The coupling slit 210 opens to the outer side of the collector 10 when viewed from the inlet 10*a*. The plate member 22 has a coupling slit 220. The coupling slit 220 opens to the inner side of the collector 10 when viewed from the inlet 10*a*.

The plate members 21 and 22 are combined with each other through the coupling slits 210 and 220. Each width of the coupling slits 210 and 220 is greater than each plate thicknesses of the plate members 21 and 22. The coupling slit 210 sandwiches a plate thickness portion on the extension line of the coupling slit 220. The coupling slit 220 sandwiches a plate thickness portion on the extension line of the coupling slit 210. The plate members 21 and 22 are fixed to the inlet 10*a* of the collector 10 in a state where the coupling slits 210 and 220 are engaged with each other. As for the plate member 22, the opening end of the coupling slit 220 is directed to the exhaust port side in FIG. 1. In the plate member 21, the opening end of the coupling slit 210 is directed to the exhaust gas purifying apparatus side in FIG. 1.

The plate members 21 and 22 are fixed to a seat plate 100 provided at a bottom portion of the inlet 10*a* and having a cross shape in a front view. The seat plate 100 includes two metal plates 101 and 102 that are substantially orthogonal to each other. A bottom side portion 21D along the long side of a plate surface 21*s* of the plate member 21 is welded to the metallic plate 102. A bottom side portion 22D along a plate surface 22*s* of the plate member 22 is welded to the metal plate 101.

Figure 3:
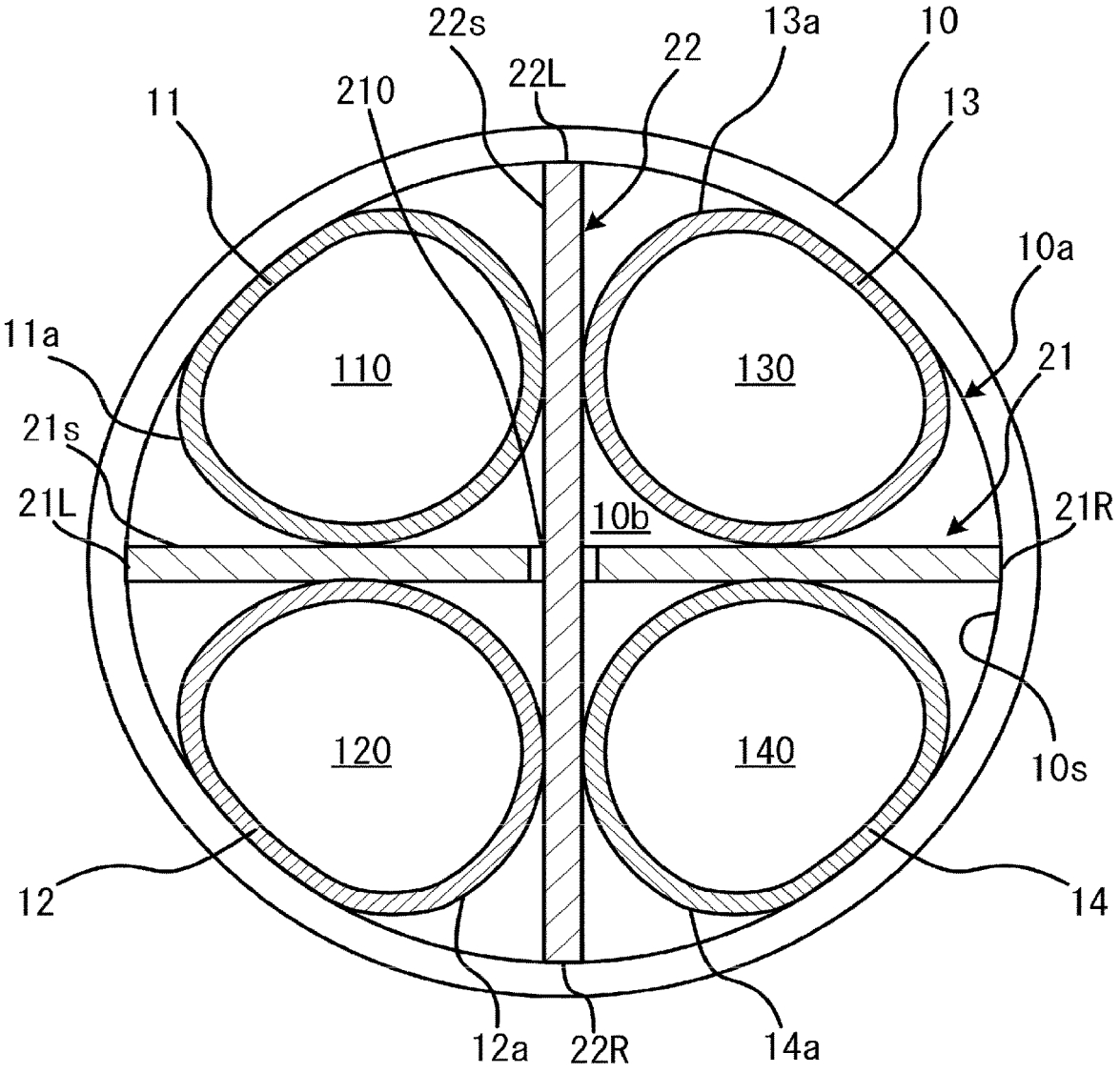
FIG. 3 is a cross-sectional view of exhaust pipes and the plate members taken along line A-A in FIG. 1.

FIG. 3 is a cross-sectional view of the exhaust pipes 11 to 14 and the plate members 21 and 22 taken along line A-A in FIG. 1. FIG. 3 illustrates a front view of the inlet 10*a* of the collector 10. The plate members 21 and 22 partition the inlet 10*a* into four sections for each of the exhaust pipes 11 to 14. Side portions 21L, 21R, 22L, 22R at both ends in the long-side direction of the plate members 21 and 22 are welded to an inner peripheral surface 10*s* of the collector 10.

Parts of outer peripheral surfaces 11*a* to 14*a* of the exhaust pipes 11 to 14 are in contact with the plate surfaces 21*s* and 22*s* of the plate members 21 and 22 and the inner peripheral surface 10*s* of the collector 10, and are fixed thereto by welding. Downstream end surfaces of the exhaust pipes 11 to 14 are welded to a bottom portion 10*b* of the inlet 10*a* so that flow paths 110 to 140 of the exhaust pipes 11 to 14 and a flow path (not illustrated) of the collector 10 communicate with each other in an airtight state.

Figure 4:
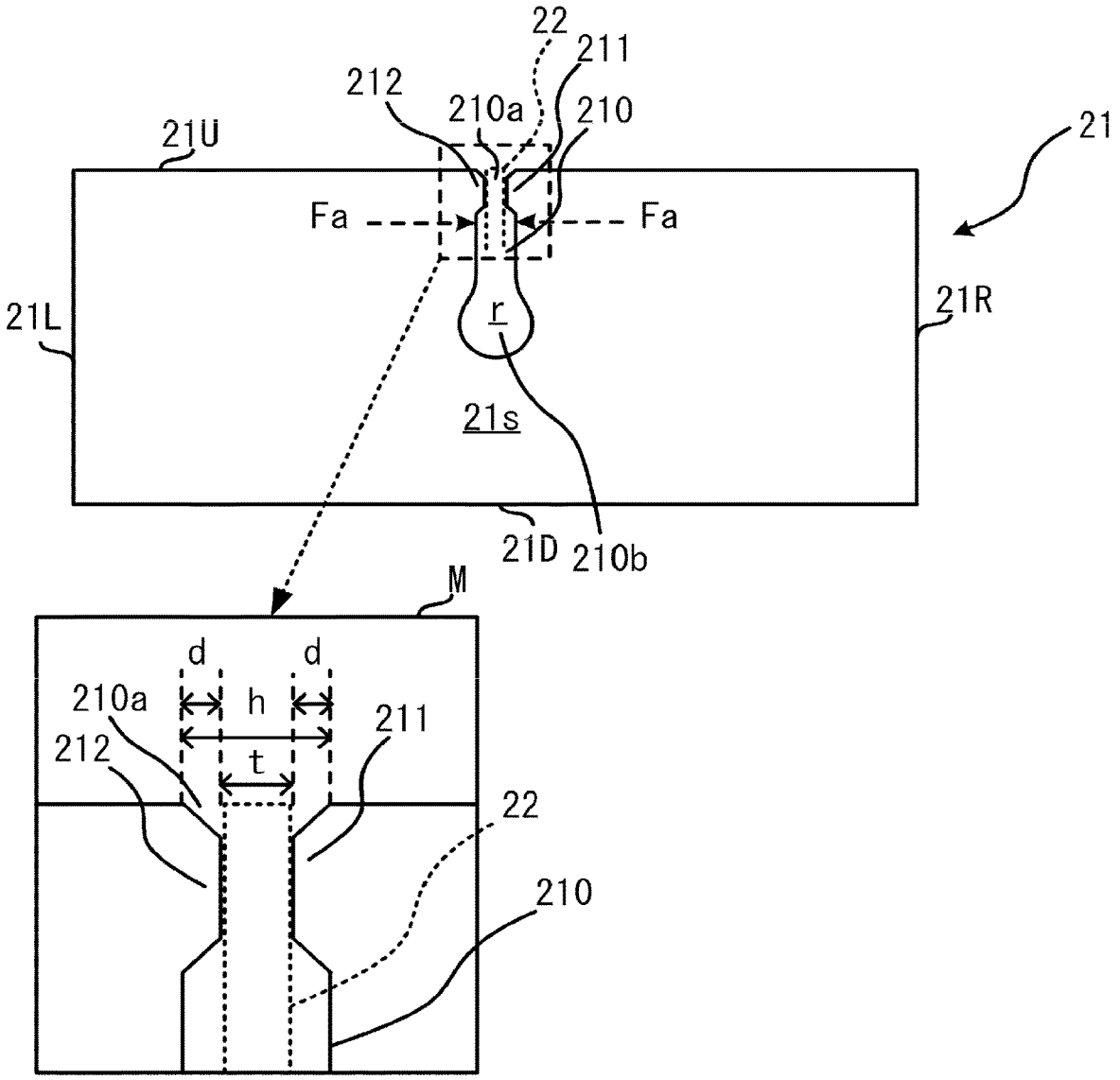
FIG. 4 is a plan view illustrating an example of one of the plate members.

FIG. 4 is a plan view illustrating an example of the plate member 21. FIG. 4 illustrates the plate member 21 when the plate surface 21*s* is viewed from the front. The coupling slit 210 of the plate member 21 opens on an upper side portion 21U. The plate member 22 is inserted into the coupling slit 210. Here, a part of the plate member 22 is indicated by a dotted line. The coupling slit 210 is an example of a slit.

High-temperature exhaust gas discharged from the internal combustion engine flows through the exhaust pipes 11 to 14. Therefore, thermal expansion occurs in the plate members 21 and 22. In contrast, the atmosphere exists around the collector 10. Therefore, the collector 10 does not thermally expand. Therefore, a stress Fa acts on the plate member 21 in a direction in which the width of the coupling slit 210 is narrowed.

When the plate member 21 is deformed such that the width of the coupling slit 210 is narrowed by the concentrated action of the stress Fa, a crack or the like might occur in the plate member 21 from the coupling slit 210 as a starting point. As a result, the reliability of the exhaust manifold 1 might be reduced. Thus, a circular region r is formed in an end portion 210*b* so as to reduce the concentration of the stress Fa. The circular region r has a diameter greater than the width h of the coupling slit 210.

However, depending on the size of the circular region r, the margin between the coupling slits 210 and 220 might become excessively large, the positioning accuracy of the plate members 21 and 22 might be lowered, and the concentration of the stress Fa on the coupling slit 210 might not be sufficiently reduced.

Therefore, the plate member 21 is provided with contact portions 211 and 212 which protrude from opposite sides of the coupling slit 210 in the width direction thereof and contact with the inserted plate member 22. For this reason, even if the stress Fa acts on the coupling slit 210, since the contact portions 211 and 212 are in contact with the plate member 22, the width of the plate member 21 is suppressed from being deformed to narrow.

Reference numeral M indicates an enlarged view of the vicinity of the contact portions 211 and 212. The contact portions 211 and 212 are provided at an opening end 210*a* of the coupling slit 210. Therefore, as compared with a case where the contact portions 211 and 212 are provided on the end portion 210*b* opposite to the opening end 210*a*, the distance from the root of the coupling slit 210 is increased. Therefore, the deformation of the plate member 21 due to the stress Fa is effectively suppressed. The circular region r is not always required.

The contact portions 211 and 212 are provided so as to sandwich the plate member 22 in the thickness direction. That is, the contact portions 211 and 212 are provided at positions opposed to each other across the coupling slit 210. Therefore, as compared with the case where the contact portions 211 and 212 are provided at different positions in the extending direction of the coupling slit 210 so as not to face each other, the stress Fa from the left and right sides of the coupling slit 210 is offset across the plate member 22. Therefore, the deformation of the plate member 21 due to the stress Fa is effectively suppressed.

Each of the contact portions 211 and 212 has a substantially rectangular shape in a front view of the plate surface 21*s*. The contact portions 211 and 212 have the upper bases of the substantially trapezoidal shapes in contact with the plate member 22. For this reason, compared with, for example, a case where the contact portions 211 and 212 are substantially rectangular, it is easier to concentrate the stress Fa on the plate member 22. Therefore, the deformation of the plate member 21 due to the stress Fa is effectively suppressed. The length of the lower base of the substantially trapezoidal shape is shorter than the length of the coupling slit 210.

Widths d (heights of the substantially trapezoidal shapes) of the contact portions 211 and 212 are substantially equal to each other, and are smaller than a width h of the coupling slit 210. The sum of the widths d of the contact portions 211 and 212 and the plate thickness t of the plate member 22 is substantially equal to the width h. Therefore, the plate member 22 is press-fitted into the coupling slit 210 of the plate member 21. The width d of each of the contact portions 211 and 212 is preferably set to, for example, one half of the plate thickness t from the viewpoint of suppressing deformation.

Figure 5:
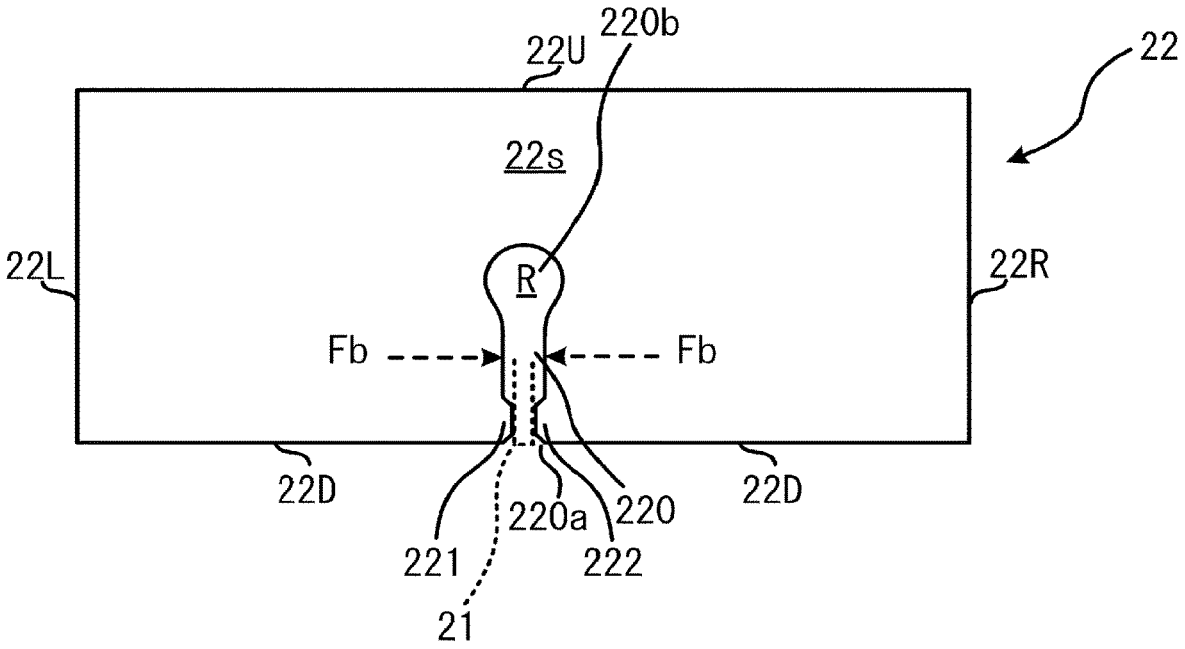
FIG. 5 is a plan view illustrating the other of the plate members.

FIG. 5 is a plan view illustrating the plate member 22. FIG. 5 illustrates the plate member 22 when the plate surface 22*s* is viewed from the front. The coupling slit 220 of the plate member 22 opens on the side of the bottom side portion 22D. The plate member 21 is inserted into the coupling slit 220. The coupling slit 220 is engaged with the plate member 21 through the coupling slit 210. Here, a part of the plate member 21 is indicated by a dotted line. The coupling slit 220 is an example of a slit.

Similarly to the plate member 21 described above, the stress Fb acts on the plate member 22 in the direction of narrowing the width of the coupling slit 220. Thus, a circular region R is formed in an end portion 220*b* so as to reduce the concentration of the stress Fb. The diameter of the circular region R is greater than the width h of the coupling slit 220. However, there might be a case where the concentration of the stress Fb is not sufficiently reduced for the reason described above.

Therefore, the plate member 22 is also provided with contact portions 221 and 222, similar to the contact portions 211 and 212 described above. The contact portions 221 and 222 protrude from both sides in the width direction of the coupling slit 220 and contact with the inserted plate member 21. Therefore, even when the stress Fb is applied to the coupling slit 220, the contact portions 221 and 222 are in contact with the plate member 21. For this reason, the width of the plate member 22 is suppressed from being deformed to narrow. The circular region R is not always required.

Each of the contact portions 221 and 222 has a substantially trapezoidal shape in a front view of the plate surface 22*s*. The contact portions 221 and 222 are provided on an opening end 220*a* of the coupling slit 220 so as to sandwich the plate member 21 in the thickness direction thereof. Therefore, similarly to the contact portions 211 and 212 described above, it is possible to effectively suppress deformation of the plate member 22 due to the stress Fb.

In the present embodiment, the deformation of the plate members 21 and 22 is suppressed by the contact portions 211, 212, 221, and 222, but the present disclosure is not limited thereto. The deformation may be suppressed by welding the plate members 21 and 22 to each other as follows.

Figure 6:
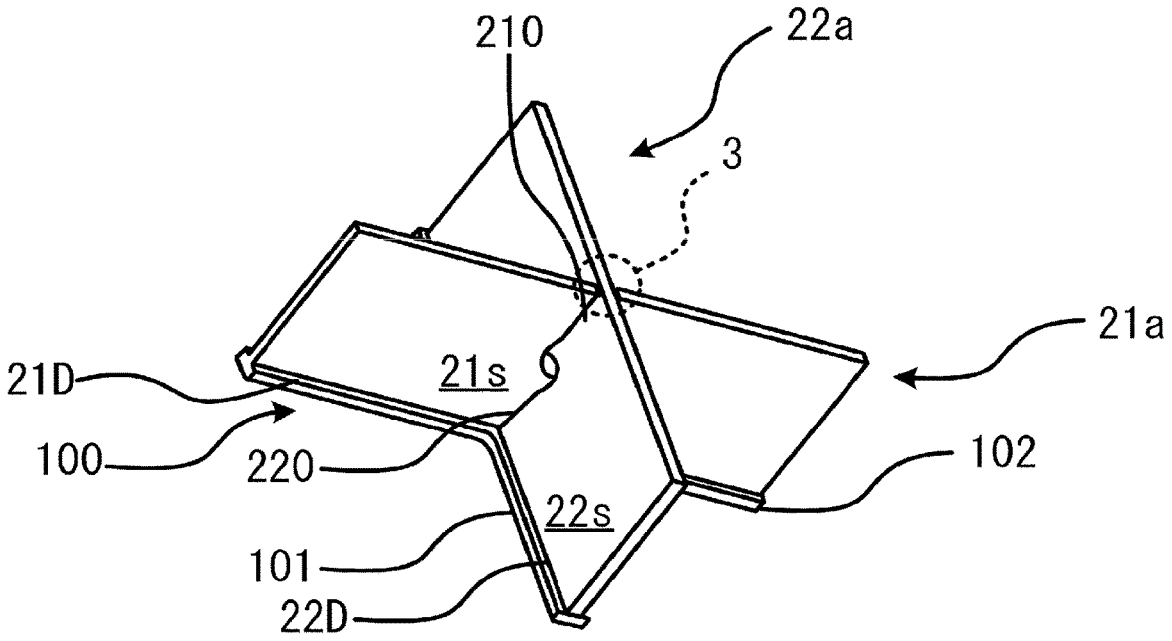
FIG. 6 is a perspective view illustrating an example of plate members that are welded to each other.

FIG. 6 is a perspective view illustrating an example of plate members 21*a* and 22*a* that are welded. In FIG. 6, the same components as those in FIG. 2 are denoted by the same reference numerals, and description thereof is omitted. Unlike the above-described plate members 21 and 22, the plate members 21*a* and 22*a* have coupling slits 210 and 220 in which the contact portions 211, 212, 221, and 222 are not formed.

The plate member 21*a* is welded to the plate member 22*a* at the opening end 210*a* of the coupling slit 210. The opening end 210*a* is melted by welding to be a welded portion 3 having a substantially spherical shape, and the welded portion 3 is integrated with the plate thickness portion of plate member 22*a*. Note that the welded portion 3 is indicated by a dotted line for convenience.

The deformation of the plate member 21*a* due to the stress Fa is suppressed by the welded portion 3. The welded portion 3 is not limited to the opening end 210*a* of the coupling slit 210, and may be another portion. That is, the plate member 21*a* may be welded to the plate member 22*a* in at least a part of the coupling slit 210. Also, the plate member 22*a* may be welded to the plate member 21*a* at least at a part of the coupling slit 220.

As described above, since the deformation of the plate members 21, 21*a*, 22, and 22*a* is suppressed, the reliability of the exhaust manifold 1 is improved.

Although some embodiments of the present disclosure have been described in detail, the present disclosure is not limited to the specific embodiments but may be varied or changed within the scope of the present disclosure as claimed.

What is claimed is:

1. An exhaust manifold comprising first and second plate members fixed to an inlet of a junction pipe at which exhaust gases from exhaust pipes join together, wherein the first and second plate members are combined with each other so as to partition the inlet for each of the exhaust pipes, the first plate member includes a slit into which the second plate member is inserted, the slit having an elongated shape, a width of the slit is greater than a plate thickness of the second plate member, the first plate member is provided with first and second contact portions at an opening end of the slit, the first and second contact portions respectively protrude from opposite sides of the slit in a width direction of the slit and contact with the second plate member inserted into the slit, and a length of each of the first and second contact portions is shorter than a half of a length of the slit in a longitudinal direction of the elongated shape.

2. The exhaust manifold according to claim 1, wherein the first and second contact portions are provided so as to sandwich the second plate member in a thickness direction of the second plate member.

3. The exhaust manifold according to claim 1, wherein each of the first and second contact portions is formed into a substantially trapezoidal shape in a front view of a plate surface of the first plate member, and the substantially trapezoidal shape includes an upper base that contacts with the second plate member.

* * * * *